US008517044B2

(12) United States Patent
Pollack et al.

(10) Patent No.: US 8,517,044 B2
(45) Date of Patent: Aug. 27, 2013

(54) LONG DISTANCE SUBMERGED HYDROCARBON TRANSFER SYSTEM

(75) Inventors: Jack Pollack, Houston, TX (US); Paul Brown, Nice (FR); Lionel Fromage, Nice (FR); Mamoun Naciri, Vallauris (FR)

(73) Assignee: Single Buoy Moorings Inc., Marly (CH)

( * ) Notice: Subject to any disclaimer, the term of this patent is extended or adjusted under 35 U.S.C. 154(b) by 384 days.

(21) Appl. No.: 12/864,291

(22) PCT Filed: Jan. 28, 2009

(86) PCT No.: PCT/EP2009/050933

§ 371 (c)(1),
(2), (4) Date: Oct. 6, 2010

(87) PCT Pub. No.: WO2009/095401

PCT Pub. Date: Aug. 6, 2009

(65) Prior Publication Data

US 2011/0033244 A1 Feb. 10, 2011

(30) Foreign Application Priority Data

Jan. 28, 2008 (EP) ..... 08101009

(51) Int. Cl.
*F16L 1/12* (2006.01)

(52) U.S. Cl.
USPC ..... 137/236.1; 405/168.4; 405/172

(58) Field of Classification Search
USPC ..... 137/236.1; 405/168.4, 172; 141/387, 141/388, 382
See application file for complete search history.

(56) References Cited

U.S. PATENT DOCUMENTS

| | | | | |
|---|---|---|---|---|
| 4,263,004 | A * | 4/1981 | Joubert et al. | 405/172 |
| 6,394,154 | B1 | 5/2002 | Pollack | |
| 6,769,376 | B2 | 8/2004 | Perera et al. | |
| 6,779,949 | B2 * | 8/2004 | Barras et al. | 405/195.1 |
| 7,677,837 | B2 | 3/2010 | Pionetti et al. | |

FOREIGN PATENT DOCUMENTS

| | | | |
|---|---|---|---|
| WO | 99/62762 | A1 | 12/1999 |
| WO | 2004/068014 | A1 | 8/2004 |
| WO | 2005/090152 | A1 | 9/2005 |
| WO | 2006/120351 | A1 | 11/2006 |

OTHER PUBLICATIONS

International Search Report, dated Dec. 4, 2009, from corresponding PCT application.

* cited by examiner

*Primary Examiner* — Kevin Lee
(74) *Attorney, Agent, or Firm* — Young & Thompson

(57) ABSTRACT

A hydrocarbon transfer system includes a first and second floating structure and a substantially horizontal transfer pipe system submerged below water level interconnecting the floating structures. The transfer pipe system includes a flow line support member which is with at least one end attached to a connection head, a number of hydrocarbon flow lines being connected along the support member via carrier members. The connection head includes a cable or chain connected to one of the floating structures, connectors situated on the connection head or at the position of the support member near the connection head, which connectors are on one side in fluid connection with the flow lines and on the other side in fluid connection with a flexible flow line extending from the connection head to the floating structure.

13 Claims, 5 Drawing Sheets

LONG DISTANCE SUBMERGED HYDROCARBON TRANSFER SYSTEM

FIELD OF THE INVENTION

The invention relates to a hydrocarbon transfer system comprising a first and second floating structure and a substantially horizontal transfer pipe system submerged below water level interconnecting the floating structures, the transfer pipe system comprising a flow line support member which is with at least one end attached to a connection head, a number of hydrocarbon flow lines being connected along the support member via carrier members, the connection head comprising a cable or chain connected to one of the floating structures and/or the sea bed, the flow lines being in fluid connection with a flexible flow line extending to the floating structure.

BACKGROUND OF THE INVENTION

Such long distance hydrocarbon transfer systems for near surface transfer of fluids from a first floating or fixed structure to a second floating structure are known from WO 2005/090152 and from SBM Offshore Annual Report 2005, and may be used in an offshore field development that is based on for example a Floating Production Storage and Offloading unit (FPSO) and a wellhead Spar Dry Tree Unit (DTU). Hydrocarbon fluids are transported in flow lines in a Gravity Actuated Pipe (GAP™) or midwater pipe system from one floating structure to the other. A bundle of flow lines is supported along a frame in a substantially horizontal direction. Due to thermal expansion an contraction of the flow lines and due to expansion in view of loading variations, stresses may occur in these flow lines, resulting in a reduced useful service life of the known transfer system. Furthermore, the motion of the floating structures may be transferred to the end parts of the support frame and to the flow line bundles, which may cause adverse fatigue effects.

Environmental conditions, distance between the floating structures, the nature of floating structures, the number of flow lines, fluid properties, fabrication/launch site characteristics and tow-out distance are the main design parameters for the known midwater pipe system. The midwater pipe system fatigue life is a very important design aspect as it comprises uneven contributions from launching, towing, installation and in-place service.

It is known to connect two floating offshore structures via a midwater pipe system for conveying hydrocarbons from one structure to the other. One floating structure may be a production or storage structure such as a spar buoy, a semi-submersible structure, a fixed tower or a mooring buoy whereas the second structure may comprise a floating production storage and offloading vessel (FPSO), a shuttle tanker and the like.

Such a known system is described in U.S. Pat. No. 6,394,154 in the name of the applicant. The transfer system includes two generally vertically oriented duct sections which are placed at an angle with the vertical. These two sections are connected to a substantially horizontal third member, for instance a third duct section. Near the connection points of the vertically oriented duct sections and the horizontal member, a tensioning weight is provided such that a tensioning force in the horizontal duct section is created. Hereby bending/kinking and/or buckling due to currents or floating systems dynamics is reduced. A relatively long horizontal duct section can be used which is preferably made of hard pipe such as rigid steel pipe.

The international patent application WO2006/120351 relates to a device for transporting fluid between two floating support structures, each anchored to the sea bed, comprising an submerged central rigid pipeline each end of which is connected to a respective floating support structure by means of a flexible pipeline. Due to its curved configuration, the rigid pipeline is not situated in a horizontal plane between its two extremities. One end is connected by a tensioning cable to a floating support structure without being connected to the sea bed and cooperates with ballasting means while the other extremity is connected to the sea bed via a chain while interacting with buoyancy means at the water surface.

U.S. Pat. No. 6,769,376 discloses systems and methods for prevention of clashing between multiple steel pipes spaced closely together and to methods of installation of multiple pipes at the same time. The system separates the transfer conduits and allows for a relative motion between the transfer conduits.

The transfer system is directly connected to the floating structures and forms a U-shape. No axial tension members are connected to the ends of the flow line.

SUMMARY OF THE INVENTION

It is an object of the present invention to provide a hydrocarbon transfer system for offshore use which can bridge a relatively large distance between the interconnected floating structures compared to the known transfer systems. It is a further object of the present invention to provide a long distance hydrocarbon transfer system which reduces tension in the flow lines upon thermal contraction or expansion and/or due to loading variations. It is again an object of the invention to provide a hydrocarbon transfer system which effectively decouples the motions of the floating structures at the water surface from the submerged flow lines. The transfer system should be adapted to be produced and installed in an economic manner.

Hereto, a transfer system according to the present invention is characterized in that one or more of the carrier members comprise a displacement device allowing displacement of the flow lines relative to the support member in a length direction. By allowing for lengthwise displacement of the flow lines along the support member, tension and buckling in the flow lines upon thermally induced dimensional changes or dimensional changes due to load variations, are prevented. The present invention allows for the use of long, horizontally arranged rigid steel piping as flow lines, without adverse effects of dimensional changes on these pipe lines.

The new transfer system may comprise a tensioned neutrally buoyant bundle of steel pipe lines suspended between the floating structures at a depth for instance 100 m and having a length of for instance 1 km or more. The flow line bundle may be built around a central, compartmented and pressurized carrier pipe that supplies both structural and buoyant support for the desired number of flow lines. Each end of the bundle is terminated with towheads which are fixed to the respective floating structures and/or the sea bed using tether chains. The flow lines are also terminated on the towheads from which flexible jumpers traverse upwards to the floating structures.

In one embodiment of a transfer system according to the invention, the displacement device comprising rollers having a rotation axis transversely oriented to the length direction. The rollers, which may be hour-glass shaped, provide a sliding guide of the flow lines along the central support.

In an alternative embodiment, the displacement device comprises cables via which the flow lines are suspended from the support member. Suspension of the flow lines along the frame provides for a relatively large degree of freedom of motion of the flow lines by which build-up of stress is avoided.

The connection head may comprise a transverse body extending transversely to the flow line support member, a towing connector being situated on the transverse body in line with the support member and attached via a universal joint to the cable or chain. The pipeline may towed to the deployment site via the towing connector after which it may be attached to a floating surface structure or to the sea bed in a submerged position, via the same connector.

The connection head may comprise a transverse body extending transversely to the flow line support member, at least two connectors being distributed along the transverse body, the flow lines being attached to the flexible flow lines via the connectors. On the transverse connection head, which is of greater width than the flow line bundle, a plurality of connectors may be placed, via which the substantially horizontal flow lines can be connected to the upwardly extending flexible flow lines while having ample space available.

A buoyancy module may be connected to a central part of the connection head, at a vertical distance there from for providing an upwards tensioning force, which may be counteracted by a anchoring cable extending from the connection head to the sea bed. A transverse ballastable tank may be attached to each side of the connection head for trimming of the connection head and for proper positioning during towing, deployment and under operational conditions. In order to facilitate transport over land, the connection head comprising two spaced-apart sliding members.

In an alternative embodiment of a transfer system in accordance with the invention, a cable extends substantially in the direction of the support member, from the connection head to a tensioning structure, an elongate tension member connecting the tensioning structure to one of the floating structures. The tensioning structure may comprise a weight and the flexible flow lines may be attached to the cable parts and to the elongate tensioning member at or near the tensioning structure.

This embodiment of a transfer system improves the longevity of the flow lines (e.g. a steel bundle) in that the new tether system design decouples the motion of the floating structure from the transfer system so as to give an adequate fatigue life to the structural bundle system.

As the dynamic motions of floating structures, especially during storms, can be large, the vertical motion transferred to one duct by way of others may cause unacceptable bending stresses near the ends of the duct. To alleviate this bending, an additional articulated pivot or flex joint may be installed.

Environmental conditions, distance between floating structures, nature of the floating structures, number of flow lines, fluid properties, fabrication/launch site characteristics, tow-out distance are the main design parameters taken into account to design a custom-made, long distance hydrocarbon transfer system. One area of particular interest in this new transfer system product relates to the system fatigue life as it comprises contributions from launching, towing, installation and in-place service, which can all be reduced with the system according to the invention.

Nominal distance between floating structures is a key parameter, as the longer the flow lines and carrier pipe for the same pretension, the more flexible they are, the more bending can become critical. Whatever the pretension, a longer transfer system also means reducing the overall weight tolerances. Besides water depth and bending, the carrier pipe design in extreme one-compartment damaged conditions is governed by floating structures relative excursions that indirectly depend on nominal relative positions.

Another important criterion is the nature of floating structures and their motions: the tethers attachment location on an FPSO, i.e. at the bow or close to midships, drastically changes the vertical motions transferred to the towhead and thus the fatigue (the response along the carrier pipe is roughly linear with regard to motions at the top of the tethers). The new transfer system is therefore preferably connected to an internal turret or close to midships connections.

BRIEF DESCRIPTION OF THE DRAWINGS

Some Embodiments of a transfer system according to the present invention will, by way of non-limiting example, be described in detail with reference to the accompanying drawings. In the drawings.

DETAILED DESCRIPTION OF THE INVENTION

Figure 1:
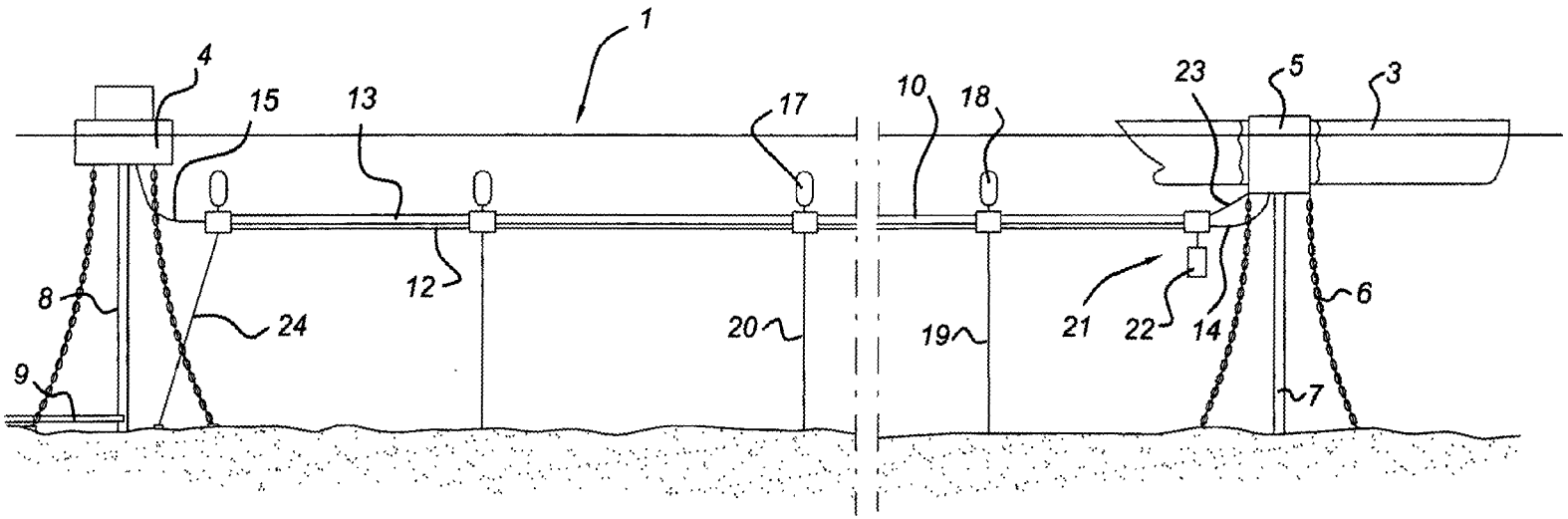
FIG. 1 shows an overall embodiment of the hydrocarbon transfer system of the invention.

FIG. 1 shows a hydrocarbon transfer system 1 comprising two floating structures 3,4. The first structure 3 may for instance comprise a FPSO having a turret 5 extending through the hull, anchored to the sea bed via anchor chains 6. The FPSO can weathervane around the turret 5 to align with prevailing wind and current directions. Hydrocarbons produced from a subsea well may be transported via risers 7, and from there on via a substantially horizontally oriented mid water transfer pipe system 10 to a rotatable transfer buoy 4. Via a riser 8, the hydrocarbons can be transferred to a pipeline 9 on the sea bed for transport to an on-shore site.

The transfer pipe system 10 may comprise flow lines formed by a number of parallel, substantially horizontal rigid steel pipes 12, that are mounted on a flow line support member 13. The transfer pipe system may have a length ranging from 100 m to several km, for instance about 4 km, and extends at a depth below water ranging from 20 m to 500 m, for instance about 150 m. Flexible flow lines 14,15 extend upwardly and connect the submerged end parts of the steel pipes 12 to the floating structures 4,5. The support member 13 is connected to buoyancy modules 17, 18 at spaced-apart locations along its length, which are anchored to the sea-bed via taut tethers 19, 20. Near the turret 5, a tensioning structure 21 is provided for exerting a horizontal tensioning force on the flow line support member 13, the structure 21 comprising a mass in the form of a clump weight 22 and a cable 23 extending upwardly at an angle to the horizontal to be connected to the turret 5. Tether 24 near the buoy 4, connects a connection head 30 at the end part of the support member 13 to the sea bed, extending at a angle to the vertical, to exert a horizontal tensioning force on the flow line support member 13.

Advantages of a pretensioned midwater pipe as described above are to limit the formation of wax and hydrates in the flow lines by remaining within a certain depth envelope close to the surface, i.e. in warmer waters. The hog and sag deflections are controlled and defined by the amount of pretension applied at both support member extremities, which support member may be formed by a carrier pipe. The midwater pipe system can be a symmetrical or asymmetrical system design and can be pretensioned at one or both ends with weights, buoyancy, inclined tethers or combination thereof. The longer the flow lines and carrier pipe, the more flexible they are, thus inducing higher dynamics, the more weight tolerances become critical.

The main challenge in developing a longer midwater pipe is to restrain the midwater pipe within acceptable hog and sag deflections respectively for safety and collapse limits.

For example the pretension of 210 tons at both carrier pipe extremities keeps a known midwater pipe below 70 m and above 300 m below the water surface, the reference being in its middle. Considering that the reference point water depth is roughly proportional to the ratio of the carrier pipe length L over the applied tension T, a 4 km-long carrier pipe would then require 650 t pre-tension to stay within similar water depths.

This tension reaches a magnitude difficult to design with, also for the floating bodies at both carrier pipe extremities and for installation operations.

This means that the long midwater pipe, depending on the nominal design length, must be provided with intermediate anchors to the seabed, as is shown in FIG. 1, or alternatively is provided with a system that circulates calibrated density fluids through one of the flow lines, to keep hog and sag fluctuations within allowable boundaries.

It is preferred that the carrier pipe has a reduced number of bulkheads to avoid the welding inside the pipe. The carrier pipe is pressurized or can alternatively be foam filled.

The long midwater support member fatigue can also be further reduced via the use of new materials instead of steel, similar with the new materials more and more employed within the dynamic risers technology like composite and titanium pipes. Titanium for example gathers a unique combination of resistance to corrosive well fluids and sea water, light weight, flexibility (60% that of steel), high strength and excellent fatigue resistance and can replace the conventional carbon steel carrier pipe material and/or flow lines. For onshore construction, GTAW is the most appropriate orbital welding process for titanium.

It is possible to elect only parts of the carrier pipe to be made of titanium (the critical fatigue zones) and to combine this with common steel parts.

Alternatively, it is further possible to use Zero Thermal Expansion (ZTE) materials in parts of the midwater flow line support member. These are materials in which Negative Thermal Expansion (NTE) materials are mixed with Positive Thermal Expansion (PTE). By combining a NTE material with PTE material it is possible to compensate for the expansion behavior of normal materials to give overall zero thermal expansion behavior.

Figure 2:
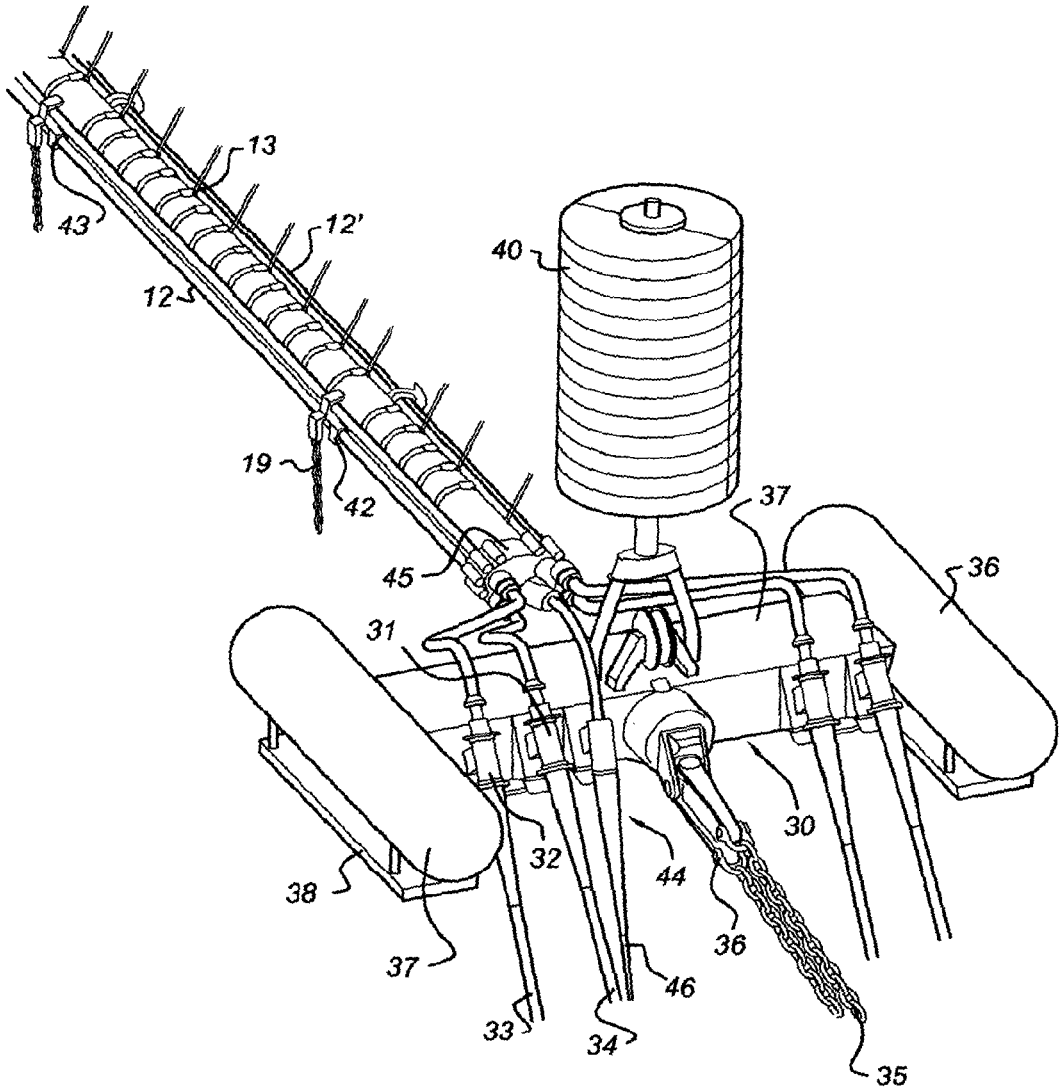
FIG. 2 shows a connection and towhead at an end of the transfer system according the invention.

FIG. 2 shows an end part of the flow line support member, or carrier pipe, 13. A transverse connection head 30 is provided at the end of the carrier pipe 13. Connectors 31, 32 are situated at spaced-apart locations extending beyond the width of the carrier pipe 13, providing space for attaching the steel flow lines 12, 12' that are mounted along the carrier pipe 13, to flexible flow lines or jumpers 33,34. The transverse connection head 30 is attached to the sea bed via tether chains 24, attached to a universal joint 36 that is able to pivot around two perpendicular axes.

Floodable Wing buoyancy tanks 35, 35' are attached at each end of the central part 37 of the connection head 30, for trimming purposes. Below each buoyancy tank 35, 35' a sliding skid 38, 38' is provided for transport of the carrier pipe 13 across land.

Figure 3:
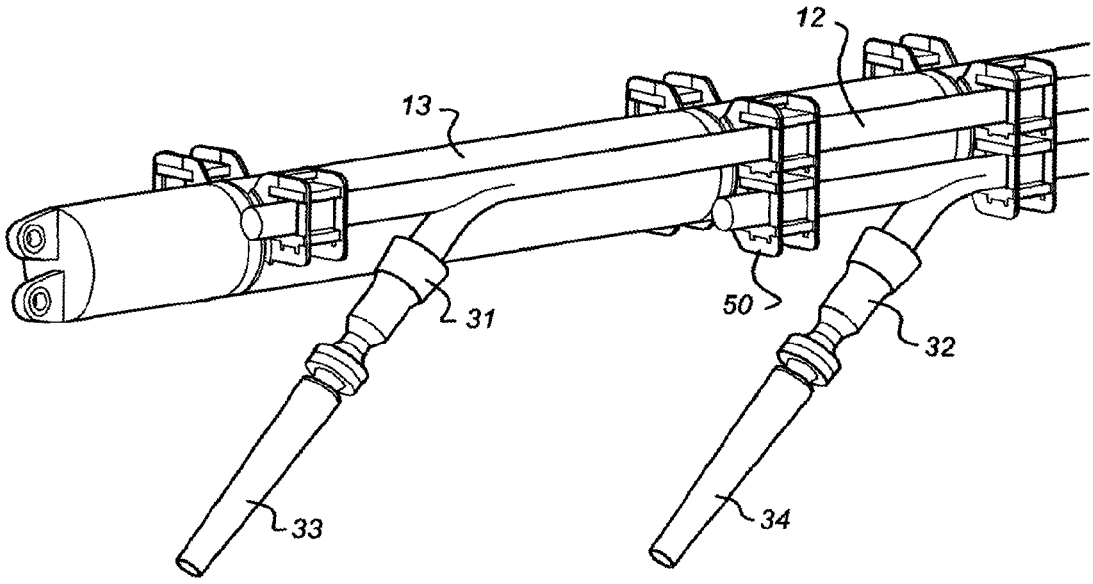
FIG. 3 shows a flow line support arrangement connecting the fluid flow lines with the carrier pipe.

An overhead buoyancy module 40 provides an upward force on the connection head 30. In order to allow for horizontal motion of the flow lines 12, 12' in the length direction of the carrier pipe 13, the flow lines are mounted on the carrier pipe via displacement devices 42, 43, which may comprise slide pads as shown in FIG. 3 or rollers of the type shown in FIG. 4.

The connection head 30 is designed for launching (floating), towing, installation (resisting for example 7 bars during hook-up) and for the in-place conditions and can weigh easily several hundreds of tons on average. That mass is dictated by the stringent structural fatigue requirements and the readiness to face damage situations. The natures of floating bodies on both sides of the midwater pipe (for example a FPSO and Spar DTU) induced two different designs of connection heads reflecting the respective amplitudes of transmitted motions through the tether chains.

Motions of midwater pipe systems are primarily engendered by their mass (and anchor lines if any), becoming a well-known "mass-spring" system. Consequently, to limit fatigue, the connection heads design avoids highly dynamic components integration with a very large lever arm, like trimming chains, and has an optimized mass. However, especially considering an enhanced de-coupled system and due to the use of new materials like titanium and/or composites, new tow methods, further caissons pressurization, the connection head could be lightened. This would also gain in repositioning the jumpers connections vertically thus reducing the connection head overall size.

The connection head is adapted to give the flow lines 12,12' the freedom to axially displace in the length direction of the carrier pipe 13. The connection head can be provided with quick jumper connectors 31,32, to connect the jumper hoses 33,34 to the flow lines 12,12' supported by the carrier pipe 13. This latter can be done diverless with the help of an ROV.

Offshore installation of the jumpers 33,34 to all sub-surface connections are preferred to be done diverless as cost of saturation diving is very high with always smaller diving spread availabilities. Quick flow line connectors like Gray lock connections are therefore placed at the towheads level.

The connection head 30 also carries an umbilical line 44, which is composed of a static section 45 and a dynamic section 46, which static section 45 is installed onshore and the dynamic section 46 is installed offshore (as per the jumpers) with flying leads (or equivalent) to mutually link the static and dynamic sections. Alternatively, the complete umbilical is installed onshore to the midwater carrier pipe 13 and only after installation the dynamic part of the umbilical is connected to the floating structure.

FIG. 3 shows an alternative embodiment for coupling the flexible jumpers 33,34 to the steel flow lines 12, 12' via connectors 31, 32 that are situated alongside the carrier pipe 13, at different heights, instead of via the connection head 30. The flow lines 12,12' are supported on slide pads 50' to be able to displace in a lengthwise direction.

Figure 4:
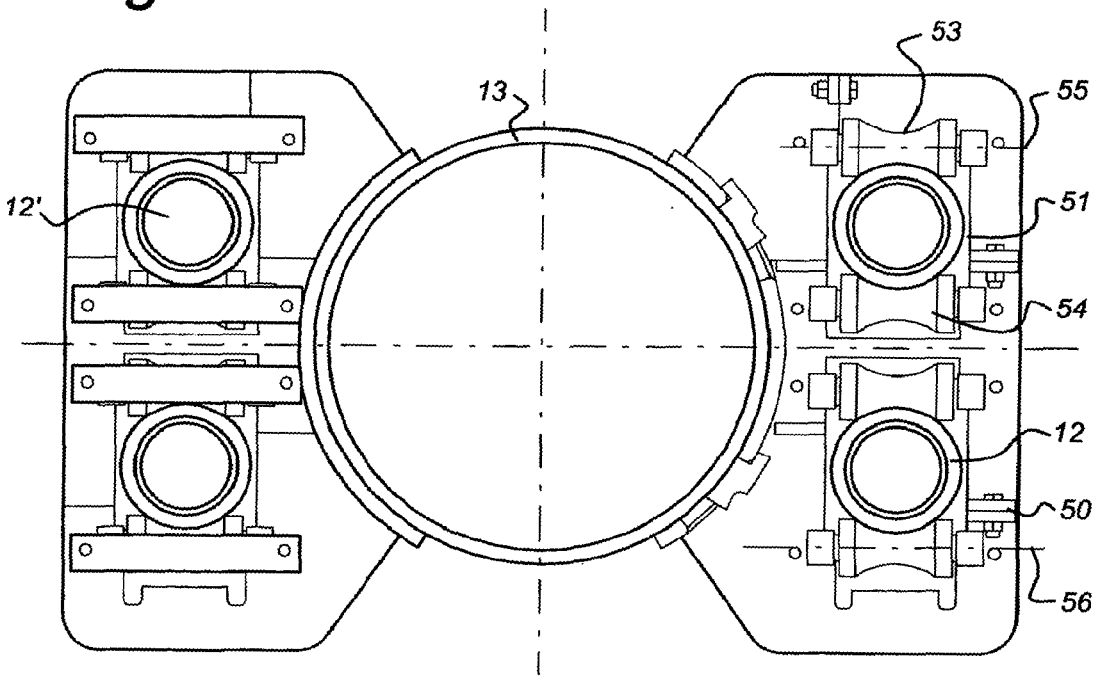
FIG. 4 shows a front view of an alternative fluid flow lines support.

FIG. 4 shows the sliding connection of the flow lines 12, 12' to the carrier pipe 13 via displacement devices 50, 51 having hour-glass shaped rollers 53, 54 clamping against each flow line 12, 12' while allowing movement in the length direction of the carrier pipe 13, which in this embodiment is oriented perpendicular to the plane of the drawing. The rollers can rotate around axes of rotation 55,56 which are oriented transversely to the length direction of the carrier pipe 13. The support of the flow lines can instead of by the use of rollers or in combination therewith, alternatively be improved by employing the sliding surfaces. These rollers or sliding surfaces allow the flow lines to move freely due to thermal growth and loading excursions over the life of the installed midwater pipe.

The roller could consist of a PU traditional hourglass-type shape mounted on a shaft of relevant diameter and material able to sustain the design life of the flow line fluctuations. Although the articulated supports are robust enough with an axial displacement capacity of about +/−250 mm for a calculated maximum of +/−100 mm, instability during installation requiring very tight tolerances motivates for developing simpler supports of the roller type for instance.

Figure 5:
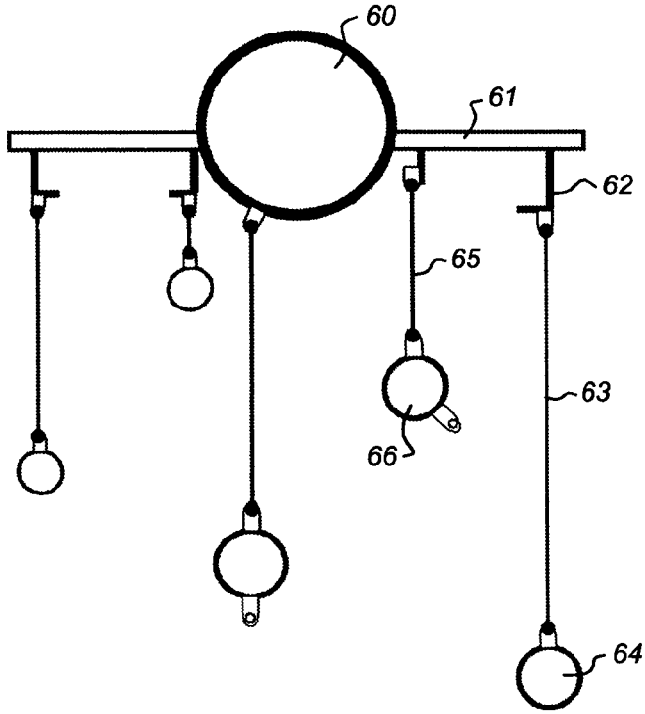
FIG. 5 shows an alternative movable fluid flow line support arrangement.
Figure 6:
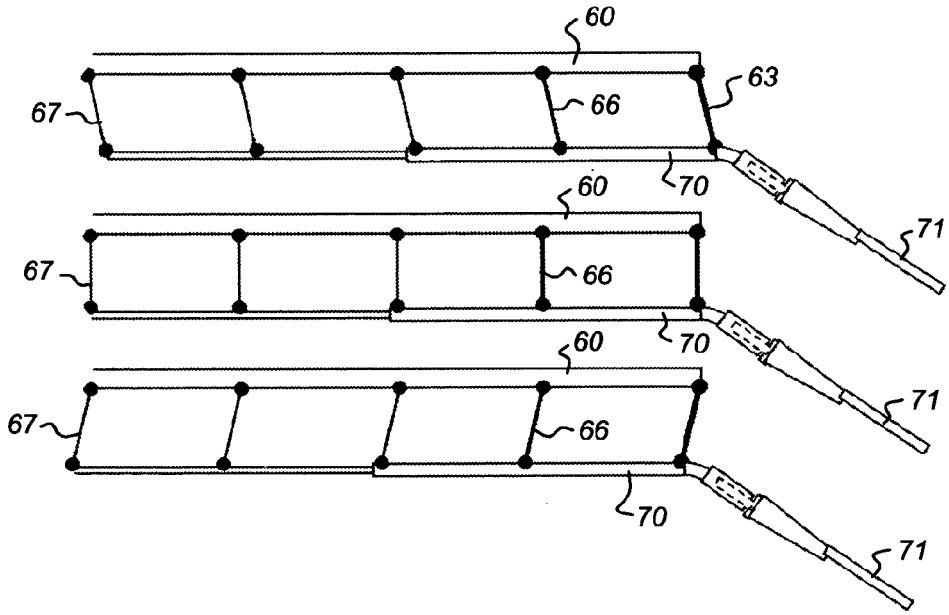
FIG. 6 shows the differences of elongation and retraction of the movable fluid flow line of FIG. 5.

In the embodiment of FIGS. 5 and 6, the displacement device comprises cables 63, 65, 66, 67 via which the flow lines 64,64', 70 are suspended from the flow line support member 60, which can be provided with transverse carrier arms 6'. FIG. 6 shows the relative motions of the flow line 70 in the length direction of the support member 60 via the flexible cable connection. At the position of the flexible flow line 71, longitudinal motion of the rigid steel flow line 70 is accommodated by the flexibility of the flow line 71.

Figure 7:
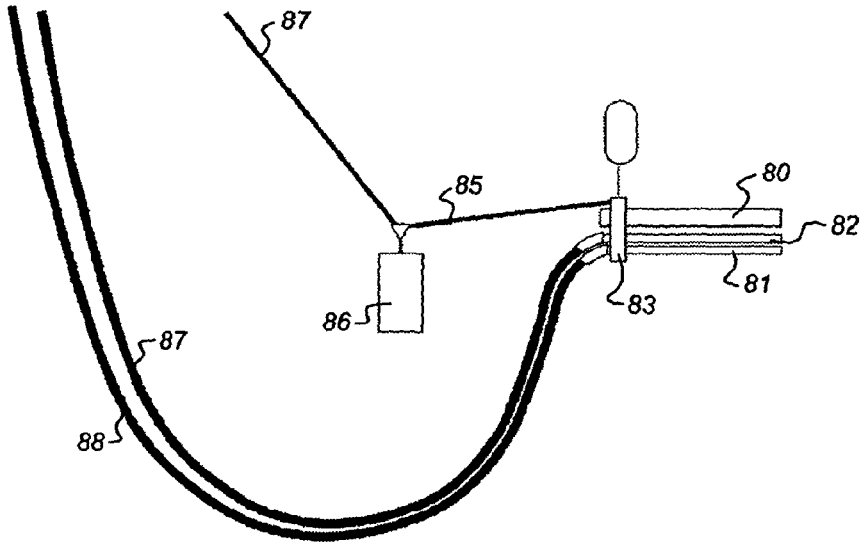
FIG. 7 shows a first embodiment of a motion decoupling arrangement at the end of the tensioned transfer system according the invention comprising a tensioning weight.

FIG. 7 shows a decoupling arrangement for decoupling movement of the floating structures from the flow line support member 80, and the connected flow lines 81,82. At the connection head 83, a substantially horizontal cable section 85 is connected to a clump weight 86, from where a cable section 87 attaches to the surface floating structure. Flexible flow lines 87, 88 extend in a free hanging loop to the surface and connect the flow lines 81, 82 in fluid connection with the surface structures.

Figure 8:
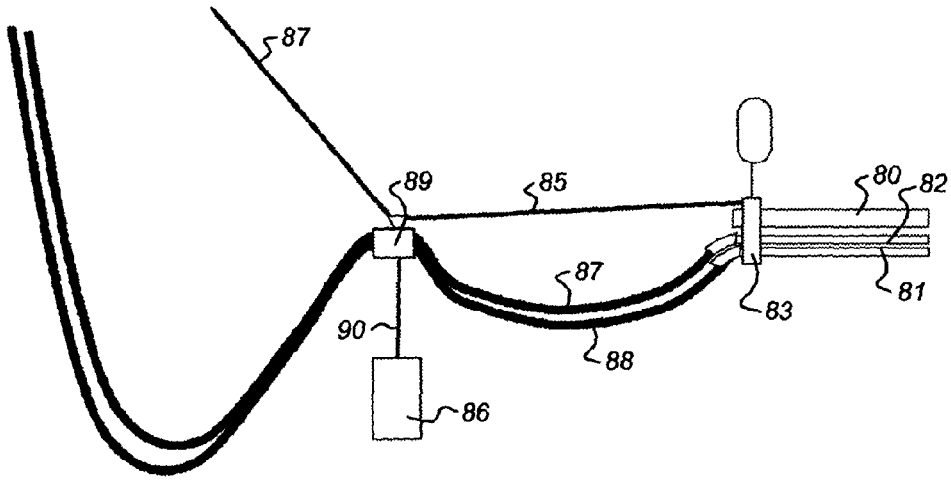
FIG. 8 shows a second embodiment of a motion decoupling arrangement wherein the flexible flow lines are attached to a tensioning weight.

In the embodiment of FIG. 8, the flexible hoses 87, 88 are connected to a coupler device 89, which attaches to the weight 86 via a cable 90. In this embodiment it is prevented that movements of the surface structure are transmitted to the flow line support member 80 and associated flow lines 81, 82 via the flexible hoses 87,88.

A long midwater pipe system 80,81,82 is prone to move more because the floating structures will move more and because its global structural damping is less. Hence decoupling of the motion of the loading structures and the connection head 83 is important. The enhanced de-coupled system for a long, pretensioned midwater pipe according to the invention includes a horizontal tension member 85 like a tether cable or chain.

Preferably the de-coupling arrangement (so-called FAT-free motion suppression system) shown in FIGS. 6 and 7 is provided at the FPSO-side of the midwater pipe, i.e. the right-hand side in FIG. 1. Flow line motions are decoupled from motions of the floating structures via a system of tether chains and unbonded flexible jumpers between the floating structure and the connection head were the flow lines are supported by a carrier pipe end. This results in highly reduced demand for large and costly flow line wall thickness and terminations dictated by severe structural fatigue phenomena.

The midwater pipe tethers are therefore preferable connected at an internal turret or connected at midship, which drastically changes the vertical motions transferred to the connection head and thus the fatigue of components (the response along the carrier pipe is roughly linear with respect to motions at the top of the tethers).

The selection of the construction site of the flow line support structure and flow lines of the mid water pipe according to the invention is very important for the midwater pipe of large length according to the invention, and is highly correlated with a large part of the detailed engineering, especially from fatigue and practicality standpoints. Onshore slope, near-shore slope and bathymetry, distance to field, vessel access to the beach, available spread fleet must be optimized.

The launching on rail tracks of the midwater pipe or sections thereof, is a technique that can be optimized with less but stronger bogies fit-for-purpose for both fabrication and launching works, still ensuring a low centre of gravity and the needed lateral compliance in the vicinity of the connection heads.

The construction of the long midwater pipe can be done perpendicular to the beach or parallel to it, depending on the circumstances. Building parallel with the water is an option if the project specifics show design and economical advantages in building in one length (e.g. testing onshore prior to departure). For extended lengths, perpendicular assembly is an option to envisage in combination with a tie-in operation during the launching period to assemble the line to its required length.

It can take for example 3 days to launch and tow a midwater pipe according to the invention to field location, 1 month to complete the diverless installation and 2 months to conduct the diving scope. The long midwater pipe is preferably towed sub-surface to the installation site. The first effort logically concentrates on optimizing the hook-up operation such that most of the connections can be made at the surface. For obvious cost advantages, the installation of the long midwater pipe is entirely diverless, which could save weeks of offshore operations and reduce all issues today linked with mobilisation of saturation diving teams. Avoiding diving operations or replacing them with ROV operations is therefore preferred.

Embodiments of a midwater hydrocarbon transfer pipe system according to the invention may have the following preferred constructional features:

- The flow line support member and flow lines may be pretensioned (with weights, buoyancy, inclined tethers or combination thereof), wherein the support member comprises a pressurized compartmented carrier pipe;
- The flow line support member may comprise a foam filled carrier pipe;
- The transfer pipe system may comprise a decoupling arrangement in which an additional horizontal chain extends between the midwater pipe and a surface floating structure to allow for decoupling the flow line extremities from the motions of floating structure;
- Pretensioned midwaterpipe with additional, distributed anchoring to the seabed (to keep hog and sag fluctuations within allowable boundaries);
- Pretensioned midwaterpipe with circulating calibrated density fluids to keep hog and sag fluctuations within allowable boundaries;
- Pretensioned midwaterpipe with a compensation system for the change of density in time of the fluids transferred (i.e. removable or adjustable ballast chains, or a flow line capable to store different density fluids);
- Pretensioned midwaterpipe with a connection head design that allows for axially displacement of the flow lines;
- Pretensioned midwaterpipe with a connection head provided with jumper hose connections;
- Pretensioned midwaterpipe with pipe supports allowing for thermal expansion of flow lines (allowing elongation/retraction of the flow lines relative to each other and/or to the carrier pipe; The motion of the flow lines is decoupled form carrier pipe in general, by means such as clamps with roller supports or sliding supports for the flow lines or by means of hanging pipes);

Pretensioned midwaterpipe with pipe support rollers (allowing the pipelines to move freely due to thermal growth and loading excursions);

Pretensioned midwaterpipe with (diverless) quick couplings between the jumper hose and the flow lines and/or between a dynamic umbilical part and a static umbilical part;

Pretensioned midwaterpipe in which the static umbilical part is preinstalled to the midwaterpipe bundle before installation (dynamic umbilical part can be connected later to the static umbilical part or alternatively the dynamic umbilical part is already connected to the static umbilical part and supported temporary by the midwater pipe);

Pretensioned midwaterpipe with a carrier pipe and/or flow lines or parts thereof made from zero thermal expansion materials;

Pretensioned midwaterpipe with composite carrier pipe and/or flow lines or parts made thereof;

Pretensioned midwaterpipe with titanium carrier pipe and/or flow lines or parts made thereof;

Midwaterpipe manufactured on an onshore or a near-shore slope provided with rail tracks for supporting and launching the midwater pipe into the sea when it is connected to and pulled-out by a vessel.

The invention claimed is:

1. A hydrocarbon transfer system, comprising:

a first floating structure;

a second floating structure; and a substantially horizontal transfer pipe system submerged below water level interconnecting the first and second floating structures, the transfer pipe system comprising a flow line support member having at least one end attached to a connection head, the connection head comprising a cable or chain connected to one of the first and second floating structures and/or the sea bed, a plurality of hydrocarbon flow lines being connected along the support member via carrier members, the hydrocarbon flow lines being in fluid connection with one or more flexible flow lines extending to the first and second floating structures, one or more of the carrier members comprising a displacement device allowing displacement of the flow lines relative to the support member in a length direction.

2. The hydrocarbon transfer system according to claim 1, wherein the displacement device comprises rollers having a rotation axis transversely oriented to the length direction.

3. The hydrocarbon transfer system according to claim 1, wherein the displacement device comprises cables via which the flow lines are suspended from the support member.

4. The hydrocarbon transfer system according to claim 1, wherein the connection head comprises a transverse body extending transversely to the flow line support member, a towing connector being situated on the transverse body in line with the support member and attached via a universal joint to the cable or chain.

5. The hydrocarbon transfer system according to claim 1, wherein the connection head comprises a transverse body extending transversely to the flow line support member, at least two connectors being distributed along the transverse body, the hydrocarbon flow lines being attached to the one or more flexible flow lines via the connectors.

6. The hydrocarbon transfer system according to claim 1, further comprising a buoyancy module connected to a central part of the connection head at a vertical distance therefrom.

7. The hydrocarbon transfer system according to claim 1, further comprising a transverse ballastable tank attached to each side of the connection head.

8. The hydrocarbon transfer system according to claim 1, wherein the connection head comprises two spaced-apart sliding members.

9. The hydrocarbon transfer system according to claim 2, wherein the displacement device comprises cables via which the flow lines are suspended from the support member.

10. A hydrocarbon transfer system, comprising:

a first floating structure;

a second floating structure; and a substantially horizontal transfer pipe system submerged below water level interconnecting the first and second floating structures, the transfer pipe system comprising a flow line support member having at least one end attached to a connection head, the connection head comprising a cable or chain connected to one of the floating structures and/or the sea bed, a plurality of hydrocarbon flow lines being connected along the support member via carrier members the hydrocarbon flow lines being in fluid connection with one or more flexible flow lines extending upwardly to the first and second floating structures, a cable extending substantially in the direction of the support member from the connection head to a tensioning structure, an elongate tension member connecting the tensioning structure to one of the first and second floating structures.

11. The hydrocarbon structure according to claim 10, wherein the tensioning structure comprises a weight.

12. The hydrocarbon structure according to claim 10, wherein the one or more flexible flow lines are attached to the cable and to the elongate tension member at or substantially proximate to the tensioning structure.

13. The hydrocarbon structure according to claim 11, wherein the one or more flexible flow lines are attached to the cable and to the elongate tension member at or substantially proximate to the tensioning structure.

* * * * *

UNITED STATES PATENT AND TRADEMARK OFFICE

CERTIFICATE OF CORRECTION

PATENT NO. : 8,517,044 B2
APPLICATION NO. : 12/864291
DATED : August 27, 2013
INVENTOR(S) : Pollack et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 453 days.

Signed and Sealed this
Fifteenth Day of September, 2015

Michelle K. Lee

Michelle K. Lee
*Director of the United States Patent and Trademark Office*